US012016471B2

(12) United States Patent
Taylor et al.

(10) Patent No.: US 12,016,471 B2
(45) Date of Patent: Jun. 25, 2024

(54) PLAYPEN

(71) Applicant: Wonderland Switzerland AG, Steinhausen (CH)

(72) Inventors: Andrew J. Taylor, Mohnton, PA (US); Daniel A. Sack, Pottstown, PA (US); Patrick J. G. Bowers, Hockessin, DE (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 17/521,953

(22) Filed: Nov. 9, 2021

(65) Prior Publication Data

US 2022/0061551 A1 Mar. 3, 2022

Related U.S. Application Data

(63) Continuation of application No. 16/566,765, filed on Sep. 10, 2019, now Pat. No. 11,197,561.

(60) Provisional application No. 62/729,721, filed on Sep. 11, 2018.

(51) Int. Cl.
*A47D 13/06* (2006.01)

(52) U.S. Cl.
CPC ..... *A47D 13/061* (2013.01)

(58) Field of Classification Search
CPC .... A47D 13/06; A47D 13/061; A47D 13/063; A47D 13/065; A47D 13/066; A47D 13/068; A47D 11/007; E05D 11/1014; A47C 19/128; A47B 3/0818
See application file for complete search history.

(56) References Cited

U.S. PATENT DOCUMENTS 2,132,988 A * 10/1938 Leibo ..... A47D 13/065 5/57.1
4,376,318 A * 3/1983 Cirillo ..... A47D 13/063 5/99.1
4,491,992 A * 1/1985 Wittman ..... A47D 9/008 5/99.1
5,241,716 A * 9/1993 Kohus ..... A47D 13/063 5/98.1
5,593,046 A * 1/1997 Katsuura ..... H05K 7/1424 312/258
5,881,789 A * 3/1999 Melashenko ..... A47G 5/00 403/217
5,937,457 A * 8/1999 Wang ..... A47D 13/063 5/98.1
5,991,944 A * 11/1999 Yang ..... A47D 9/016 403/231
7,748,798 B2 * 7/2010 LeTourneau ..... A47B 43/00 312/258

(Continued)

*Primary Examiner* — Justin C Mikowski
*Assistant Examiner* — George Sun
(74) *Attorney, Agent, or Firm* — NZ CARR LAW OFFICE

(57) ABSTRACT

A playpen includes a plurality of standing legs, an upper frame assembly coupled with the standing legs and having an unfolded state and a folded state, and a locking mechanism for locking the upper frame assembly in the unfolded state. The upper frame assembly includes a corner joining part, a middle joining part, and a bar respectively connected pivotally with the corner joining part and the middle joining part about a first and a second pivot axis, the first and second pivot axes extending substantially vertically when the playpen stands on a floor surface.

17 Claims, 14 Drawing Sheets

(56) References Cited

U.S. PATENT DOCUMENTS

2008/0127412 A1* 6/2008 Pleiman ..... A47D 13/063 5/99.1
2009/0289473 A1* 11/2009 Kmieciak ..... B60R 21/38 296/193.11
2012/0248394 A1* 10/2012 Thorne ..... A47D 13/061 256/25
2013/0047335 A1* 2/2013 Zeng ..... A47D 9/016 5/655
2013/0074257 A1* 3/2013 Mendes ..... F16C 11/10 16/349
2013/0240815 A1* 9/2013 Wiegmann ..... A47D 13/061 256/25
2013/0326808 A1* 12/2013 Saint ..... A47D 9/016 5/93.1
2014/0061563 A1* 3/2014 Weisbeck ..... A47D 13/066 256/25
2014/0075670 A1* 3/2014 Crumrine ..... A23C 9/1322 256/25
2014/0325756 A1* 11/2014 Thorne ..... A47D 13/061 5/99.1
2016/0183698 A1* 6/2016 Szymanski ..... A47D 13/066 5/99.1
2016/0270557 A1* 9/2016 Horst ..... A47D 13/063
2016/0309914 A1* 10/2016 Burns ..... A47D 9/005
2017/0172311 A1* 6/2017 Longenecker ..... A47D 13/061
2017/0290444 A1* 10/2017 Mao ..... A47D 13/063
2018/0008056 A1* 1/2018 Yang ..... F16B 7/14
2018/0146796 A1* 5/2018 Longenecker ..... A47D 9/005
2018/0168365 A1* 6/2018 Huang ..... A47D 7/002
2018/0220809 A1* 8/2018 D'Urso ..... A47D 15/003
2019/0142183 A1* 5/2019 Mountz ..... A47D 13/063 5/99.1
2019/0350378 A1* 11/2019 Schaffer ..... A47D 13/066
2020/0352342 A1* 11/2020 Xu ..... F16B 12/56

* cited by examiner

100

PLAYPEN

CROSS-REFERENCE TO RELATED APPLICATION(S)

This application is a continuation application of U.S. patent application Ser. No. 16/566,765 filed on Sep. 10, 2019, which claims priority to U.S. provisional application No. 62/729,721 filed on Sep. 11, 2018, the disclosures of both of which are hereby incorporated by reference as if set forth in their entireties herein.

BACKGROUND

1. Field of the Invention

The present invention relates to playpens for children.

2. Description of the Related Art

Most playpen frames currently available on the market include top rails that are connected with one another via four top rail corners, and four standing legs respectively connected with the top rail corners. Moreover, the standing legs may have foot portions respectively connected with a bottom center hub through multiple bar linkages. In use, the bottom center hub may be unlocked and pulled upward, which can move the standing legs close to one another for collapsing the playpen frame. This conventional construction has only one folding configuration that is typically used for storage of the playpen. Once it is folded, the playpen usually has to be lifted for transport, which may be cumbersome.

Therefore, there is a need for an improved playpen that is more convenient and flexible in use, and can address at least the foregoing issues.

SUMMARY

The present application describes a playpen for young children that can independently fold and unfold standing legs, and have multiple folding configurations to offer more flexibility for convenient transport and storage of the playpen.

According to one aspect, the playpen includes a plurality of standing legs, an upper frame assembly coupled with the standing legs and having an unfolded state and a folded state, and a locking mechanism for locking the upper frame assembly in the unfolded state. The upper frame assembly includes a corner joining part, a middle joining part, and a bar respectively connected pivotally with the corner joining part and the middle joining part about a first and a second pivot axis, the first and second pivot axes extending substantially vertically when the playpen stands on a floor surface.

According to another aspect, the playpen includes a plurality of standing legs, an upper frame assembly coupled with the standing legs and having an unfolded state and a folded state, and a locking mechanism for locking the upper frame assembly in the unfolded state. The upper frame assembly has a side frame portion including two bars that are respectively connected pivotally with a middle joining part about two pivot axes, the two pivot axes extending substantially vertically when the playpen stands on a floor surface.

DETAILED DESCRIPTION OF THE EMBODIMENTS

Figure 1:
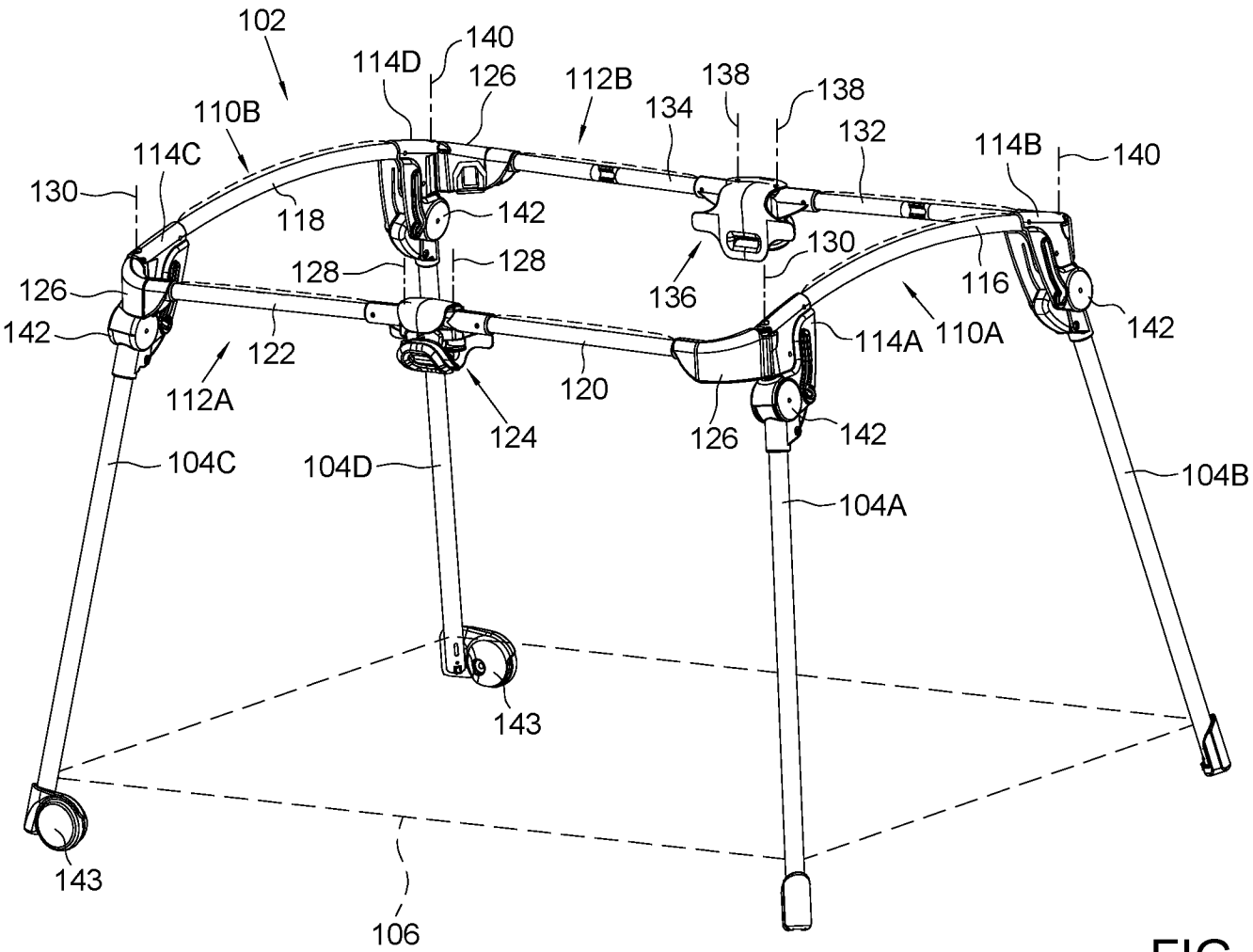
FIG. 1 is a perspective view illustrating an embodiment of a playpen.
Figure 2:
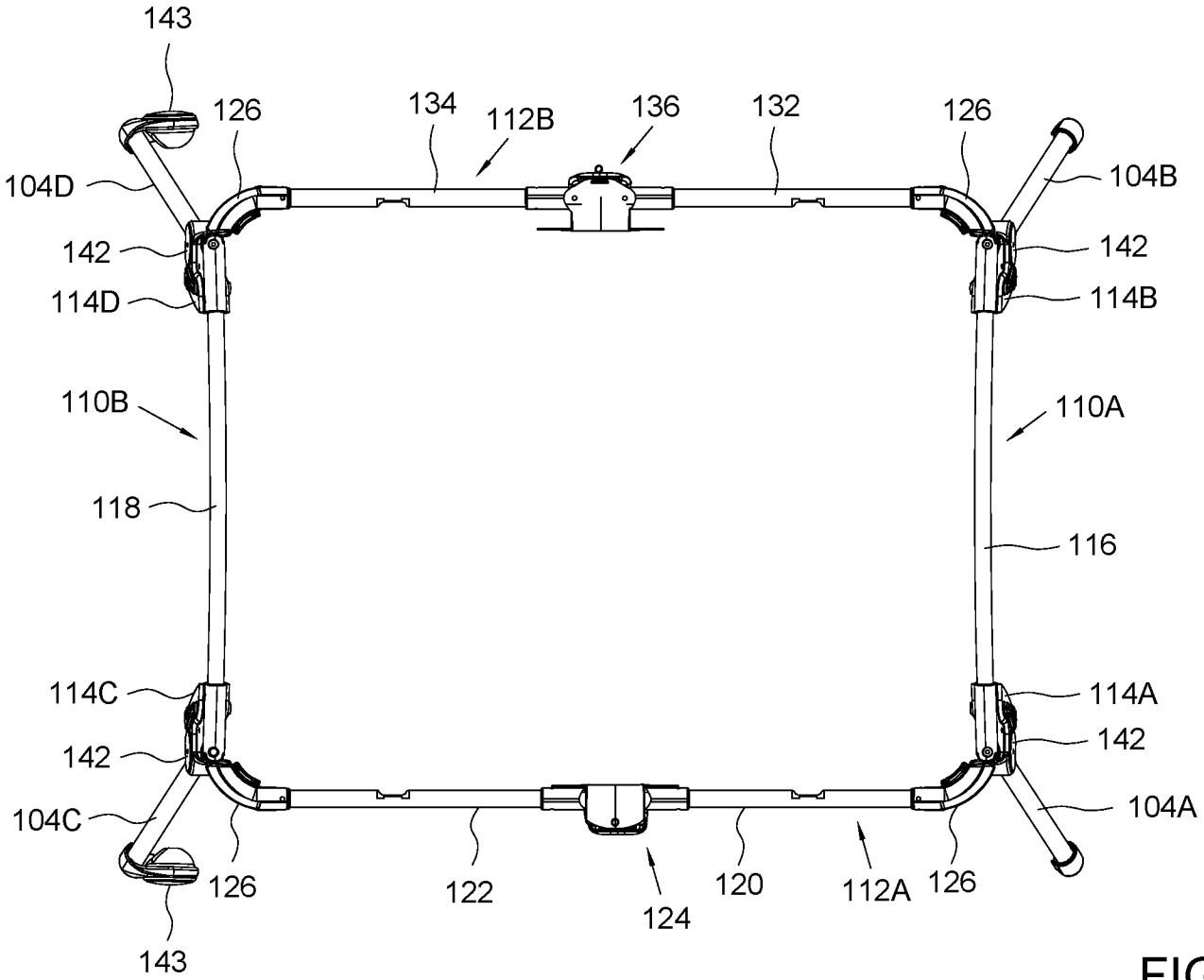
FIG. 2 is a top view of the playpen.

FIG. 1 is a schematic view illustrating an embodiment of a playpen 100, and FIG. 2 is a top view of the playpen 100. Referring to FIGS. 1 and 2, the playpen 100 can include an upper frame assembly 102, and a plurality of standing legs 104A, 104B, 104C and 104D. The upper frame assembly 102 can be coupled with upper end portions of the standing legs 104A, 104B, 104C and 104D. An enclosure 106 (shown with phantom lines in FIG. 1) can be stretched between the standing legs 104A, 104B, 104C and 104D to surround an inner space of the playpen 100 where a young child can be received. The enclosure 106 can be formed by the assembly of one or more fabric, and can have an upper end secured with the upper frame assembly 102.

The upper frame assembly 102 can be formed by the assembly of multiple bars defining a closed shape. In one embodiment, the upper frame assembly 102 can include two side frame portions 110A and 110B opposite to each other and extending substantially parallel to each other along a first direction, two other side frame portions 112A and 112B opposite to each other and extending substantially parallel to each other along a second direction perpendicular to the first direction, and a plurality of corner joining parts 114A, 114B, 114C and 114D that connect the side frame portions 110A and 110B with the side frame portions 112A and 112B.

Referring to FIGS. 1 and 2, the side frame portion 110A can include a continuous bar 116 having two opposite ends respectively connected fixedly with two corner joining parts 114A and 114B. For example, the two opposite ends of the bar 116 can be fixedly attached in two openings respectively provided in the two corner joining parts 114A and 114B.

Likewise, the side frame portion 110B can include a continuous bar 118 having two opposite ends respectively connected fixedly with two other corner joining parts 114C and 114D. According to an example of construction, each of the corner joining parts 114A, 114B, 114C and 114D may be integrally formed as a unitary part.

The side frame portion 112A is disposed between the two side frame portions 110A and 110B, and includes two bars 120 and 122 that are respectively connected pivotally with a middle joining part 124 at a middle of the side frame portion 112A. Moreover, the two bars 120 and 122 can be respectively connected pivotally with the two corner joining parts 114A and 114C at two opposite ends of the side frame portion 112A. For example, each of the two bars 120 and 122 can be respectively connected fixedly with a coupling part 126 having a curved shape that is pivotally connected with the corresponding corner joining part 114A or 114C. The two bars 120 and 122 can be respectively connected pivotally with the middle joining part 124 about two generally parallel pivot axes 128, and the two coupling parts 126 of the bars 120 and 122 can be respectively connected pivotally with the two corner joining parts 114A and 114C about two generally parallel pivot axes 130. The pivot axes 128 and 130 can extend substantially vertically when the playpen 100 stands on a floor surface.

The side frame portion 112B is disposed between the two side frame portions 110A and 110B opposite to the side frame portion 112A, and likewise includes two bars 132 and 134 that are respectively connected pivotally with a middle joining part 136 at a middle of the side frame portion 112B. The two bars 132 and 134 can be respectively connected pivotally with the two other corner joining parts 114B and 114D at two opposite ends of the side frame portion 112B, e.g., via two coupling parts 126 like described previously. The two bars 132 and 134 can be respectively connected pivotally with the middle joining part 136 about two generally parallel pivot axes 138, and the two coupling parts 126 of the bars 132 and 134 can be respectively connected pivotally with the two corner joining parts 114B and 114D about two generally parallel pivot axes 140. The pivot axes 138 and 140 can extend substantially vertically when the playpen 100 stands on a floor surface.

The upper frame assembly 102 can thus have two sides defined by the two side frame portions 110A and 110B that are not foldable, and two sides defined by the two side frame portions 112A and 112B that are foldable. The two middle joining parts 124 and 136 of the side frame portions 112A and 112B can move toward each other for folding the upper frame assembly 102 and away from each other for unfolding the upper frame assembly 102. When the upper frame assembly 102 is in the unfolded state as shown in FIGS. 1 and 2, the two side frame portions 112A and 112B can be generally parallel to each other with the two middle joining parts 124 and 136 spaced apart from each other by a distance, the side frame portions 112A and 112B being longer than the side frame portions 110A and 110B, i.e., the side frame portions 112A and 112B respectively define two longer sides of the playpen 100 and the side frame portions 110A and 110B respectively define two shorter sides of the playpen 100. When the upper frame assembly 102 is in the folded state, the two side frame portions 112A and 112B are folded about the two middle joining parts 124 and 136 which are displaced closer to each other, thereby reducing a distance between the two side frame portions 110A and 110B.

Referring again to FIGS. 1 and 2, the standing legs 104A, 104B, 104C and 104D can be respectively connected pivotally with the corner joining parts 114A, 114B, 114C and 114D via a plurality of pivot connections 142. The standing legs 104C and 104D may respectively have wheels 143 for facilitating transport of the playpen 100. Each of the standing legs 104A, 104B, 104C and 104D can rotate independently relative to the corner joining part 114A, 114B, 114C and 114D between an unfolded position where the standing leg is deployed for providing standing support on a floor surface (as shown in FIGS. 1 and 2) and a folded position where the standing leg is folded toward the upper frame assembly 102. More specifically, each of the standing legs 104A and 104B can project downward from the side frame portion 110A for providing standing support in the unfolded position, and can be folded toward the side frame portion 110A in the folded position. Likewise, each of the standing legs 104C and 104D can project downward from the side frame portion 110B for providing standing support in the unfolded position, and can be folded toward the side frame portion 110B in the folded position. The standing legs 104A, 104B, 104C and 104D may be folded and unfolded while the upper frame assembly 102 remains in the folded or unfolded state.

With the aforementioned construction, the playpen 100 can have two independent folding configurations: a first folding configuration can reduce a distance between the two side frame portions 110A and 110B by folding the upper frame assembly 102 about the two middle joining parts 124 and 136, and a second folding configuration can reduce a height of the playpen 100 by folding the standing legs 104A, 104B, 104C and 104D. When only the upper frame assembly 102 is folded while the standing legs 104A, 104B, 104C and 104D remain unfolded, the playpen 100 may be able to stand upright on the standing legs 104A, 104B, 104C. This may facilitate transport of the playpen 100, e.g., from one room to another inside a house. For a more compact storage, the standing legs 104A, 104B, 104C and 104D can further be folded toward the side frame portions 110A and 110B at the shorter sides of the upper frame assembly 102.

Figure 3:
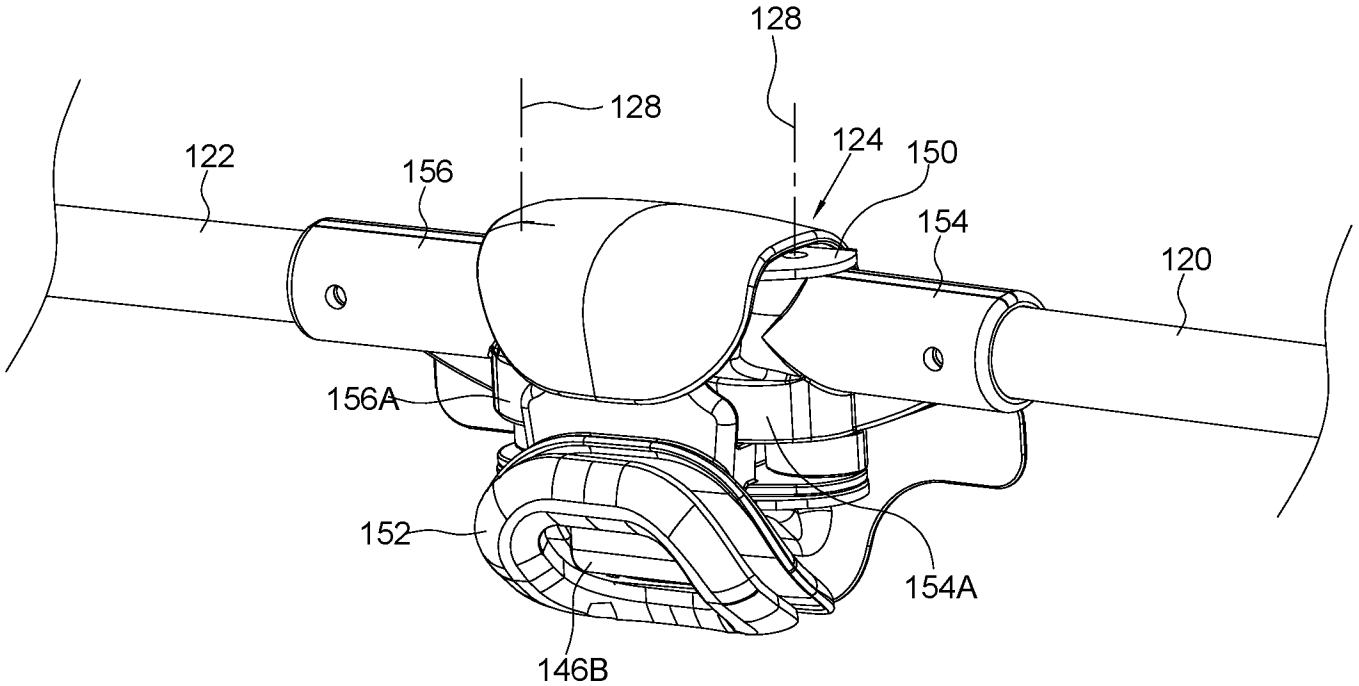
FIG. 3 is an enlarged view illustrating a middle joining part of a side frame portion in the playpen.
Figure 4:
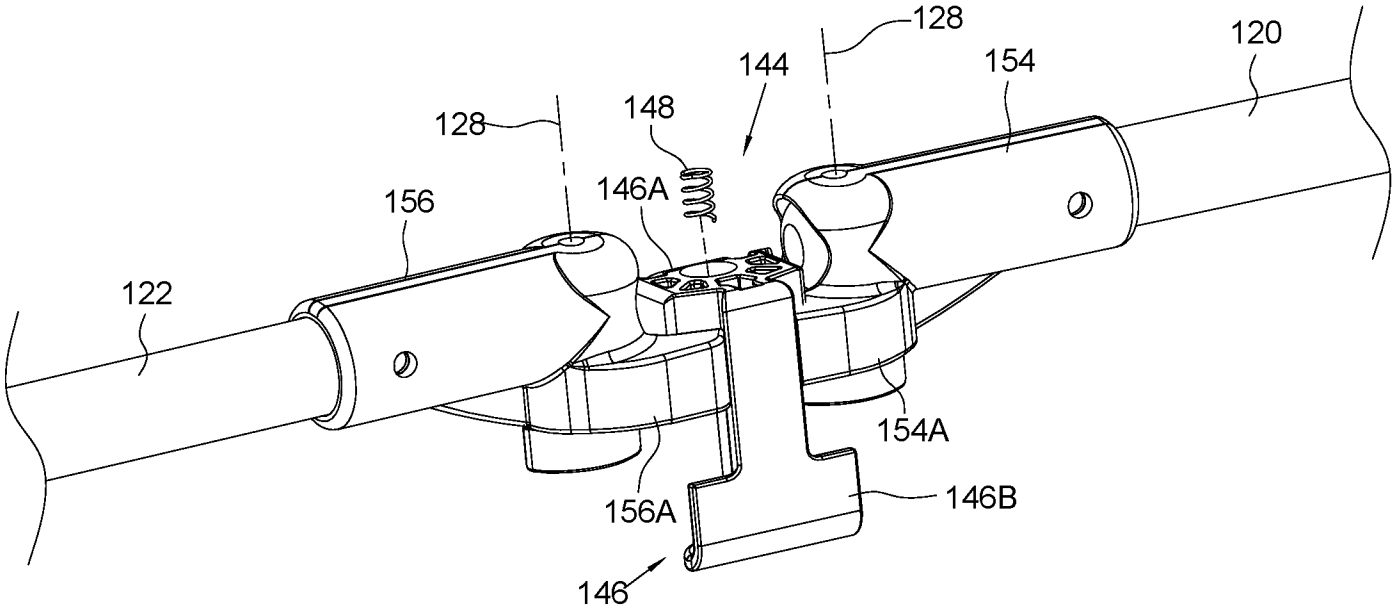
FIG. 4 is a perspective view illustrating construction details of a locking mechanism assembled with the middle joining part for locking an upper frame assembly of the playpen in an unfolded state.

In conjunction with FIGS. 1 and 2, FIG. 3 is an enlarged view illustrating the middle joining part 124 of the side frame portion 112A, and FIG. 4 is a perspective view illustrating a locking mechanism 144 assembled with the middle joining part 124 for locking the upper frame assembly 102 in the unfolded state. Referring to FIGS. 3 and 4, the locking mechanism 144 can include a latch 146 and a spring 148 assembled with the middle joining part 124. According to an example of construction, the middle joining part 124 can include a bracket 150 and a housing 152 fixedly connected with each other, and the latch 146 can be movably connected with the housing 152. The latch 146 is movable between a locking position where the latch 146 can engage with the two bars 120 and 122 of the side frame portion 112A for locking the upper frame assembly 102 in the unfolded state, and an unlocking position where the latch 146 can disengage from the two bars 120 and 122 for adjustment of the upper frame assembly 102 between the unfolded state and the folded state.

According to an exemplary embodiment, the two bars 120 and 122 can respectively have two end coupling parts 154 and 156 that are fixedly attached to the respective ends of the bars 120 and 122 and respectively have extensions 154A and 156A for engagement with the latch 146. The extensions 154A and 156A are respectively connected fixedly with the end coupling parts 154 and 156, e.g., the end coupling part 154 and the extension 154A may be formed integrally as a single part, and the end coupling part 156 and the extension 156A may be formed integrally as a single part. The end coupling parts 154 and 156 can be respectively connected pivotally with the bracket 150 of the middle joining part 124 about the two pivot axes 128 so that the end coupling parts 154 and 156 are respectively rotatable along with the bars 120 and 122 about the pivot axes 128, and the extensions 154A and 156A can extend into a gap between the two pivot axes 128.

Figure 5:
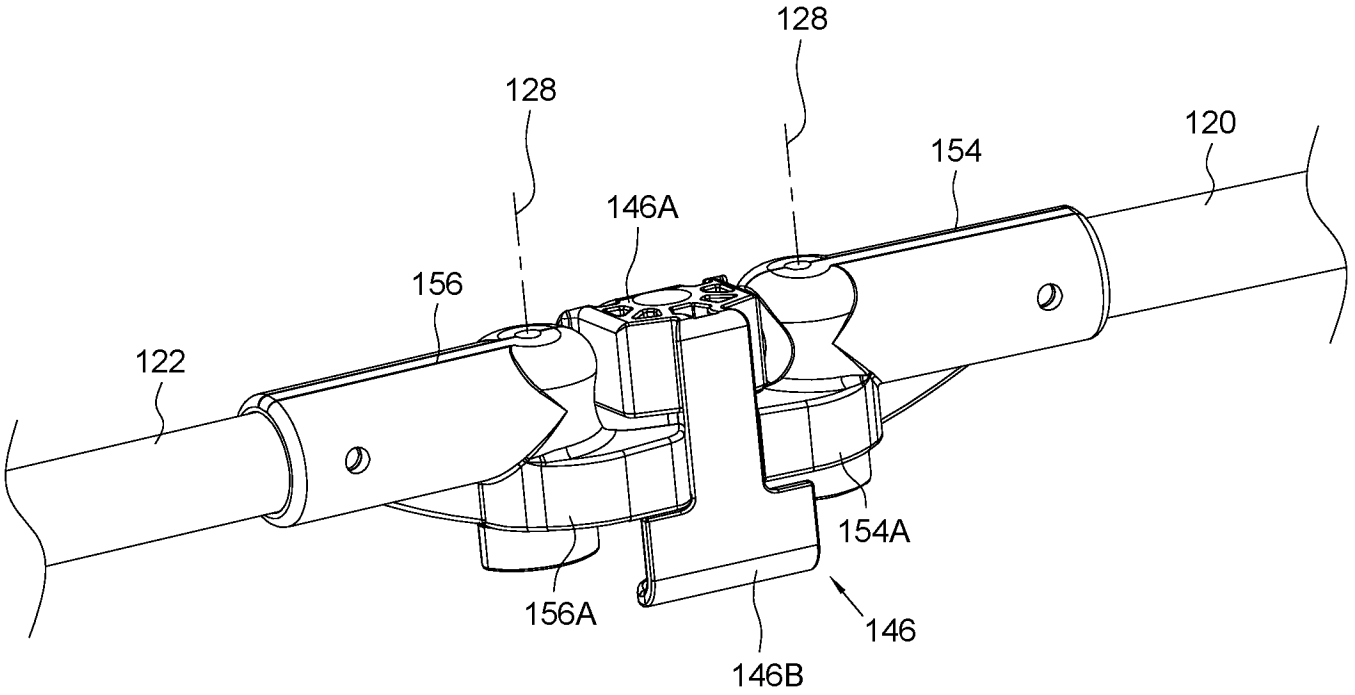
FIG. 5 is a perspective view illustrating a latch of the locking mechanism shown in FIG. 4 in an unlocking position.

The latch 146 can have a locking portion 146A disposed in the gap between the pivot axes 128, and is movable to engage and disengage the locking portion 146A with respect to the extensions 154A and 156A of the end coupling parts 154 and 156. More specifically, the locking portion 146A of the latch 146 can engage with the extensions 154A and 156A in the locking position, and disengage from the extensions 154A and 156A in the unlocking position. According to an example of construction, the latch 146 may be slidably assembled with the middle joining part 124, and can slide in a first direction to engage with the extensions 154A and 156A and in a second direction opposite to the first direction to disengage from the extensions 154A and 156A. FIG. 4 illustrates the latch 146 in the locking position, and FIG. 5 illustrates the latch 146 in the unlocking position.

Referring to FIGS. 3 and 4, the spring 148 is respectively connected with the latch 146 and the middle joining part 124, and is configured to bias the latch 146 toward the locking position. For example, the spring 148 can have two opposite ends respectively connected with the middle joining part 124 and the locking portion 146A of the latch 146.

Referring to FIGS. 3 and 4, the latch 146 may further have an actuating portion 146B exposed through the housing 152 of the middle joining part 124 for operation. According to an example of construction, the latch 146 and the actuating portion 146B can be formed integrally as a single part. A caregiver can press the actuating portion 146B to cause the latch 146 to move against the biasing force of the spring 148 from the locking position to the unlocking position.

According to an embodiment, the same locking mechanism 144 described previously may be provided in the middle joining part 136 of the side frame portion 112B for locking the upper frame assembly 102 in the unfolded state.

Figure 6:
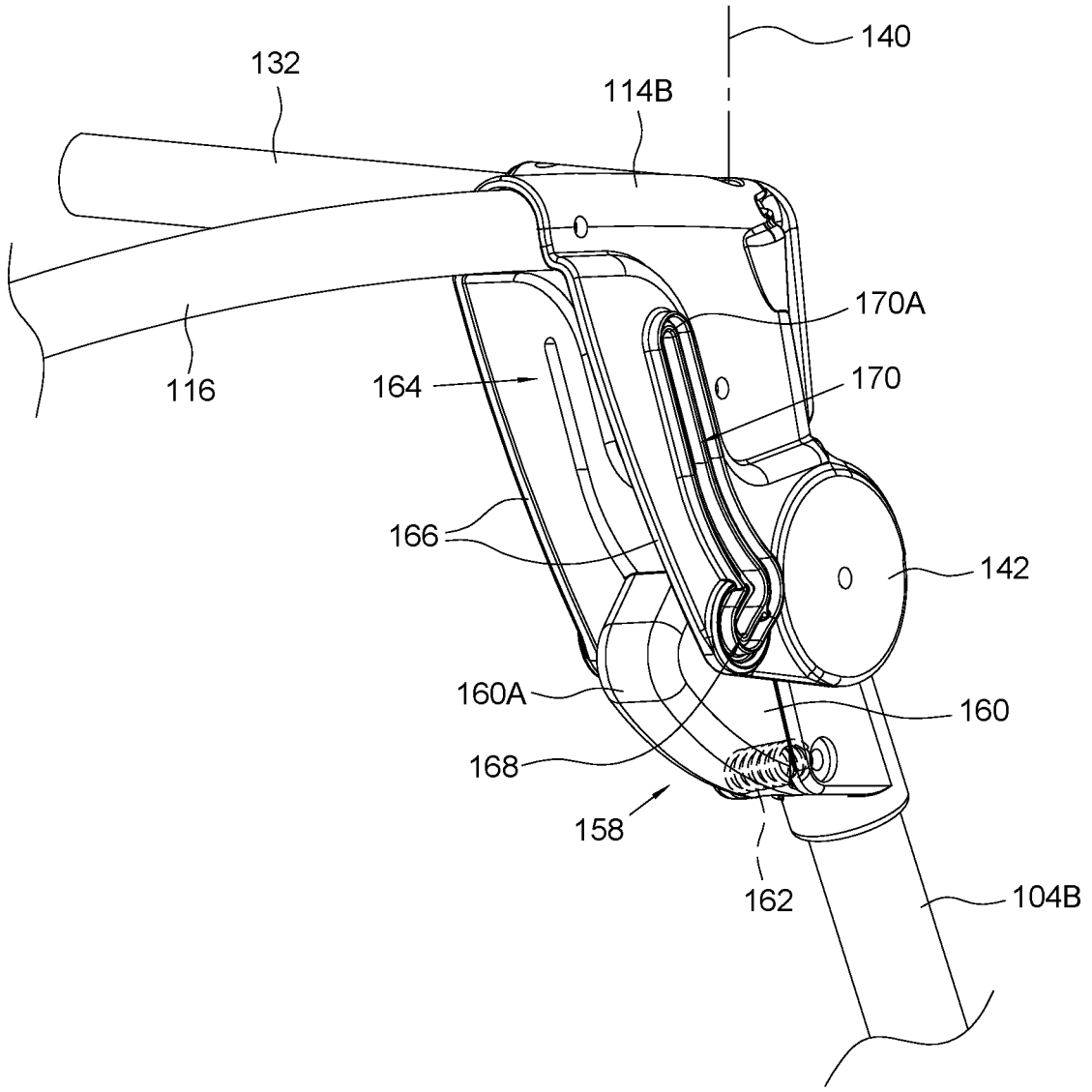
FIG. 6 is a perspective view illustrating a locking mechanism disposed adjacent to a corner joining part for locking a standing leg of the playpen in an unfolded position.
Figure 7:
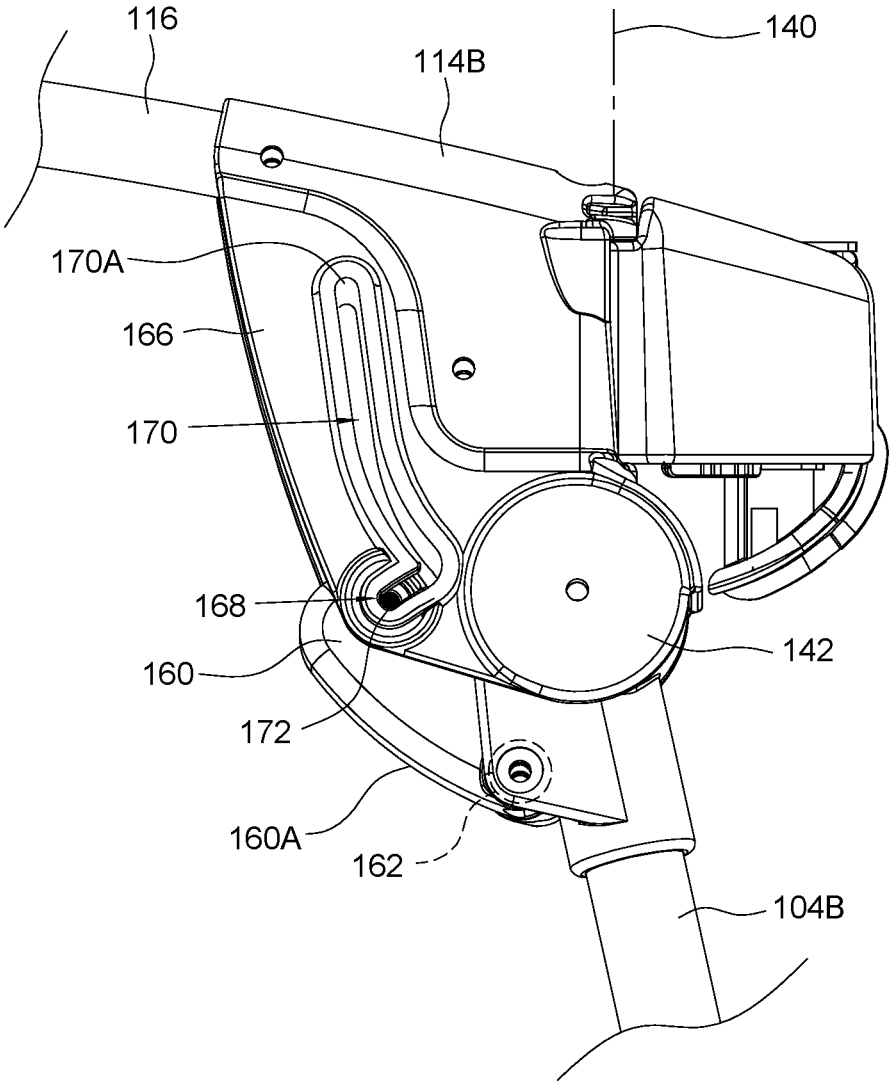
FIG. 7 is a side view illustrating the locking mechanism for locking the standing leg in the unfolded position.

In conjunction with FIG. 1, FIGS. 6 and 7 are respectively a perspective and a side view illustrating a locking mechanism 158 disposed adjacent to the corner joining part 114B for locking the standing leg 104B in the unfolded position. Referring to FIGS. 6 and 7, the locking mechanism 158 can include a latch 160 and a spring 162 (shown with phantom lines in FIGS. 6 and 7). The latch 160 is movably connected with the standing leg 104B, and is operable to lock the standing leg 104B in the unfolded position and to unlock the standing leg 104B for rotation of the standing leg 104B between the unfolded position and the folded position.

According to an example of construction, the corner joining part 114B can include a cavity 164 delimited at least partially between two opposite sidewalls 166 of the corner joining part 114B, and a locking slot portion 168 and a channel 170 symmetrically provided on the two sidewalls 166. The locking slot portion 168 is connected with the channel 170, and forms a bend from the channel 170. The latch 160 can engage with the locking slot portion 168 to lock the standing leg 104B in the unfolded position, and can disengage from the locking slot portion 168 for rotation of the standing leg 104B between the unfolded position and the folded position. For example, the latch 160 is fixedly connected with a pin 172, and is movable relative to the standing leg 104B to engage and disengage the pin 172 with respect to the locking slot portion 168. The standing leg 104B can be locked in the unfolded position when the pin 172 is engaged with the locking slot portion 168 and unlocked when the pin 172 is disengaged from the locking slot portion 168. According to an example of construction, the latch 160 can be pivotally connected with the standing leg 104B, whereby the latch 160 can rotate relative to the standing leg 104B to engage with and disengage from the locking slot portion 168.

Once the latch 160 is disengaged from the locking slot portion 168, the latch 160 is movable along with the standing leg 104B during rotation of the standing leg 104B relative to the corner joining part 114B. For example, the pin 172 of the latch 160 can enter the channel 170 when the latch 160 is disengaged from the locking slot portion 168, and can then slide along the channel 170 during rotation of the standing leg 104B between the unfolded position and the folded position. The pin 172 can slide along the channel 170 toward an end 170A of the channel 170 opposite to the locking slot portion 168 when the standing leg 104B is folded toward the upper frame assembly 102, and can slide along the channel 170 toward the locking slot portion 168 when the standing leg 104B is unfolded for use. The latch 160 can be at least partially received in the cavity 164 of the corner joining part 114B during rotation of the standing leg 104B.

Referring to FIGS. 6 and 7, the spring 162 can be respectively connected with the latch 160 and the standing leg 104B. The spring 162 can bias the latch 160 toward a locking position where the pin 172 is engaged with the locking slot portion 168 for locking the standing leg 104B in the unfolded position. According to an example of construction, the spring 162 may be a torsion spring assembled around the pivot connection of the latch 160.

According to an example of construction, the latch 160 can have an actuating portion 160A exposed for operation. The actuating portion 160A may be formed integrally with the latch 160. A caregiver can press the actuating portion 160A to cause the latch 160 to move to the unlocking position and disengage from the locking slot portion 168 for unlocking the standing leg 104B.

Figure 8:
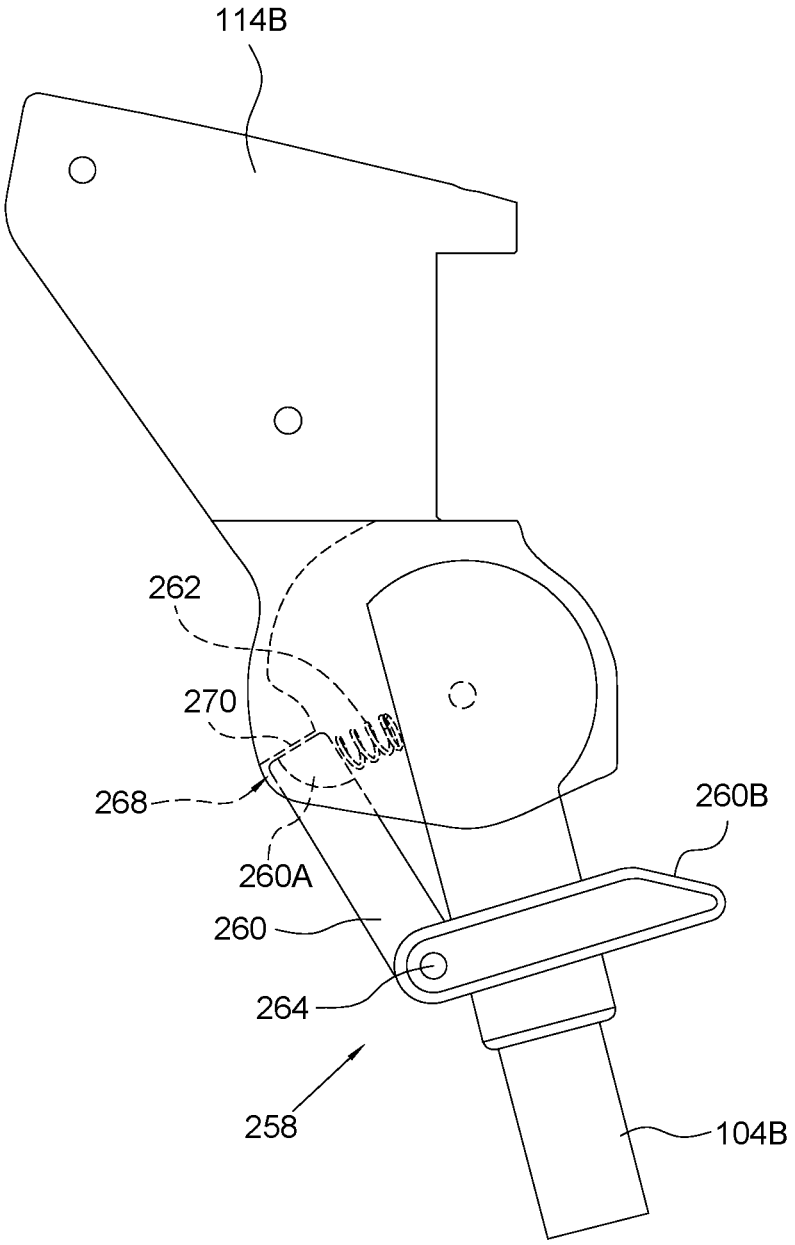
FIG. 8 is a schematic view illustrating another construction of a locking mechanism disposed adjacent to a corner joining part for locking a standing leg in the unfolded position.

FIG. 8 is a schematic view illustrating another construction of a locking mechanism 258 disposed adjacent to the corner joining part 114B for locking the standing leg 104B in the unfolded position. Referring to FIG. 8, the standing leg 104B can be pivotally connected with the corner joining part 114B like previously described, and the locking mechanism 258 can include a latch 260 and a spring 262 (shown with phantom lines). The latch 260 can be pivotally connected with the standing leg 104B via a pivot connection 264, and can rotate relative to the standing leg 104B and the corner joining part 114B to engage and disengage a locking slot portion 268 (shown with phantom lines) provided inside the corner joining part 114B. For example, the locking slot portion 268 can be at least partially delimited by a sidewall 270, and the latch 260 can have a protrusion 260A that engages through the locking slot portion 268 and contacts with the sidewall 270 to prevent a folding rotation of the standing leg 104B, which can be thereby locked in the unfolded position. The protrusion 260A can be provided on the latch 260 distant from the pivot connection 264.

The spring 262 can be respectively connected with the latch 260 and the standing leg 104B, and can bias the latch 260 toward a locking position engaged with the locking slot portion 268. According to an example of construction, the spring 262 may have one end connected with the standing leg 104B and another end connected with the latch 260 at a location adjacent to the protrusion 260A, as shown in FIG.

8. According to another example of construction, the spring 262 may be replaced with a torsion spring assembled around the pivot connection 264.

Figure 9:
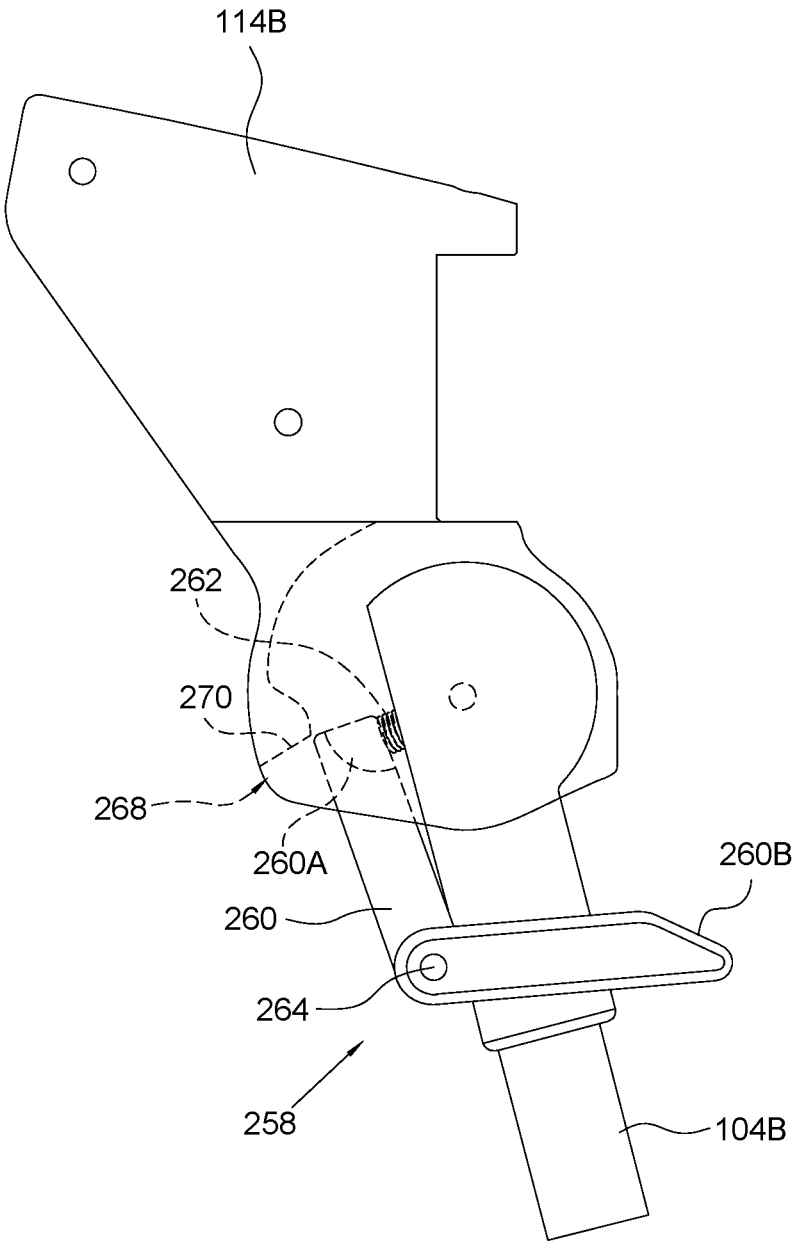
FIGS. 9 and 10 are schematic views illustrating exemplary operation of the locking mechanism shown in FIG. 8 for folding the standing leg.
Figure 10:
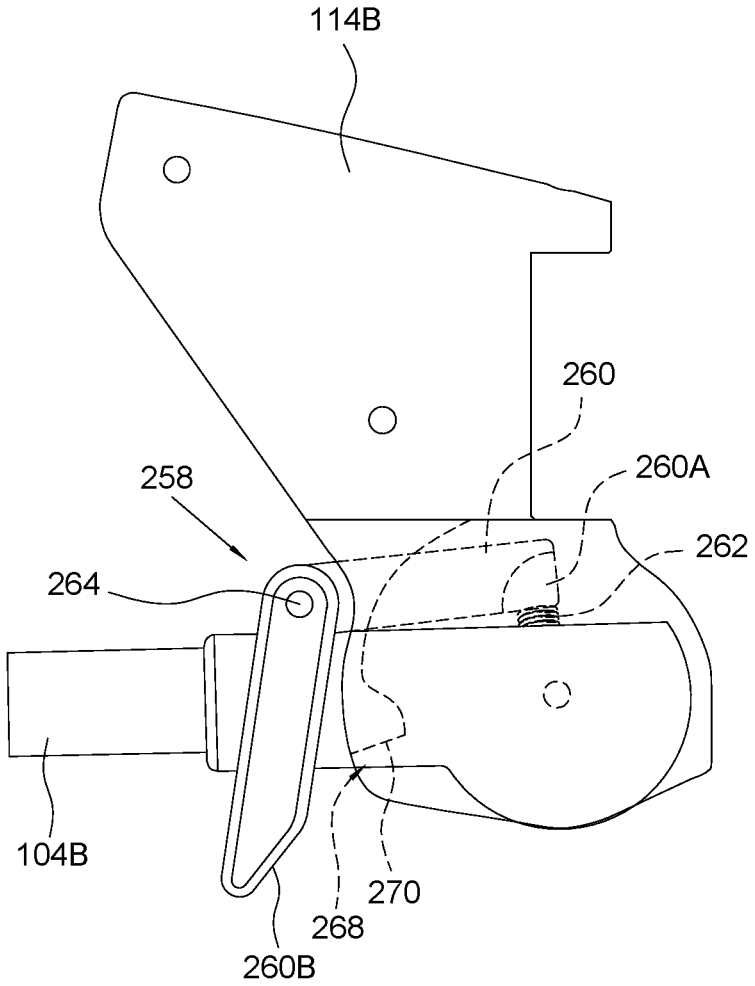

Referring to FIG. 8, the latch 260 can have an actuating portion 260B exposed for operation. The actuating portion 260B may be formed integrally with the latch 260, or fixedly fastened to the latch 260. According to an example of construction, the latch 260 may have a generally L-shape, and the protrusion 260A and the actuating portion 260B can be respectively located adjacent to two opposite ends of the latch 260. Referring to FIGS. 9 and 10, a caregiver can press the actuating portion 260B to cause the latch 160 to rotate and disengage the protrusion 260A from the locking slot portion 268 for unlocking the standing leg 104B. Once the latch 260 is disengaged from the locking slot portion 268, the latch 260 is movable along with the standing leg 104B during rotation of the standing leg 104B relative to the corner joining part 114B.

Figure 11:
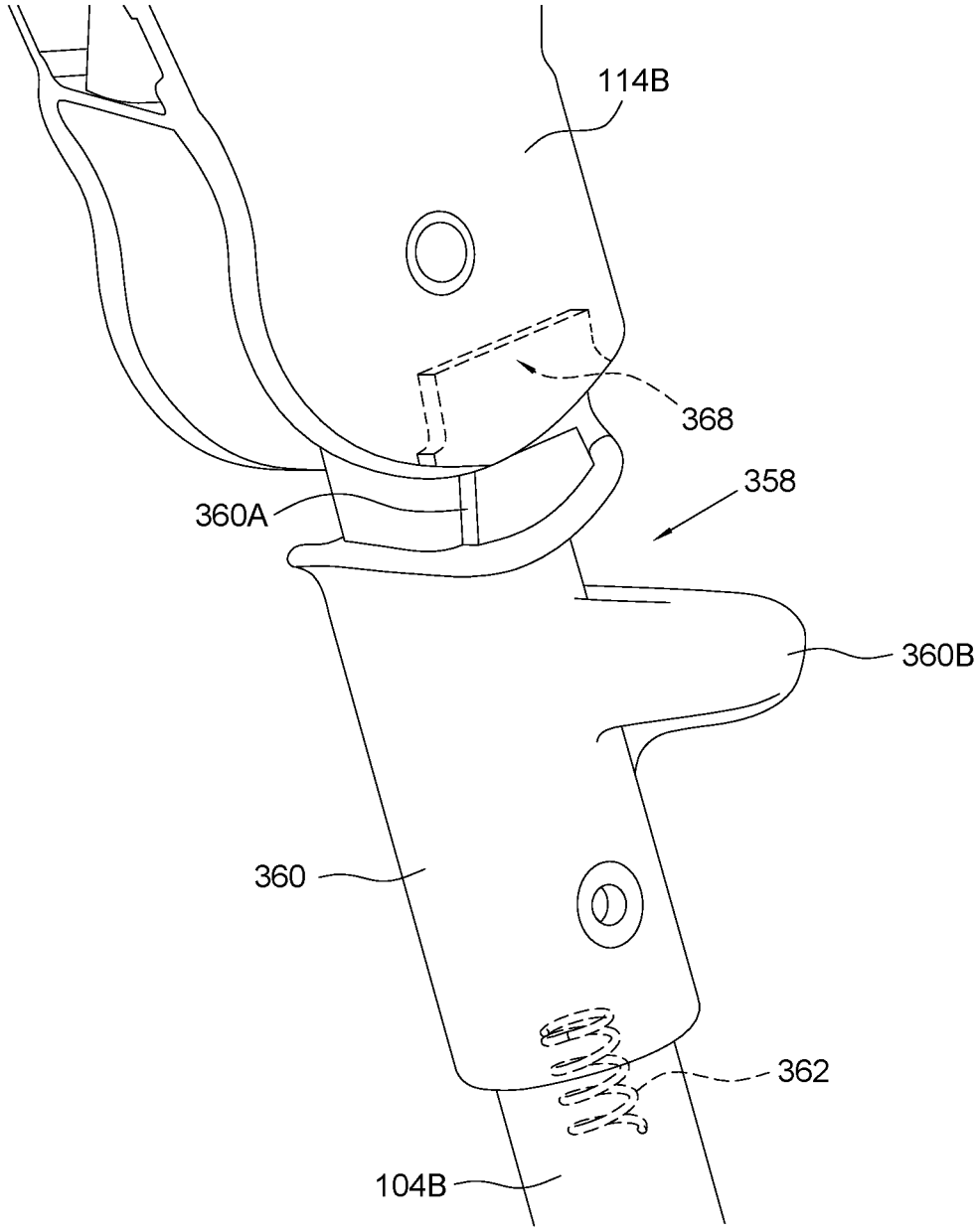
FIG. 11 is a schematic view illustrating another variant construction of a locking mechanism disposed adjacent to a corner joining part for locking a standing leg in the unfolded position.

FIG. 11 is a schematic view illustrating another variant construction of a locking mechanism 358 disposed adjacent to the corner joining part 114B for locking the standing leg 104B in the unfolded position. Referring to FIG. 11, the locking mechanism 358 can include a latch 360 and a spring 362 (shown with phantom lines). The latch 360 can be slidably connected with the standing leg 104B, and can slide along the standing leg 104B to engage with and disengage from a locking slot portion 368 (shown with phantom lines) provided in the corner joining part 114B. For example, the latch 360 can slide upward relative to the standing leg 104B to engage a rib 360A of the latch 360 with the locking slot portion 368 for locking the standing leg 104B in the unfolded state, and can slide downward relative to the standing leg 104B to disengage from the locking slot portion 368 for unlocking the standing leg 104B.

The spring 362 can be respectively connected with the latch 360 and the standing leg 104B. The spring 362 can bias the latch 360 toward the locking position engaged with the locking slot portion 368.

Referring to FIG. 11, the latch 360 can have an actuating portion 360B exposed for operation. According to an example of construction, the actuating portion 360B may be formed integrally with the latch 360. A caregiver can press the actuating portion 360B to cause the latch 360 to move to the unlocking position and disengage from the locking slot portion 368 for unlocking the standing leg 104B. Once the latch 360 is disengaged from the locking slot portion 368, the latch 360 is movable along with the standing leg 104B during rotation of the standing leg 104B relative to the corner joining part 114B.

Figure 12:
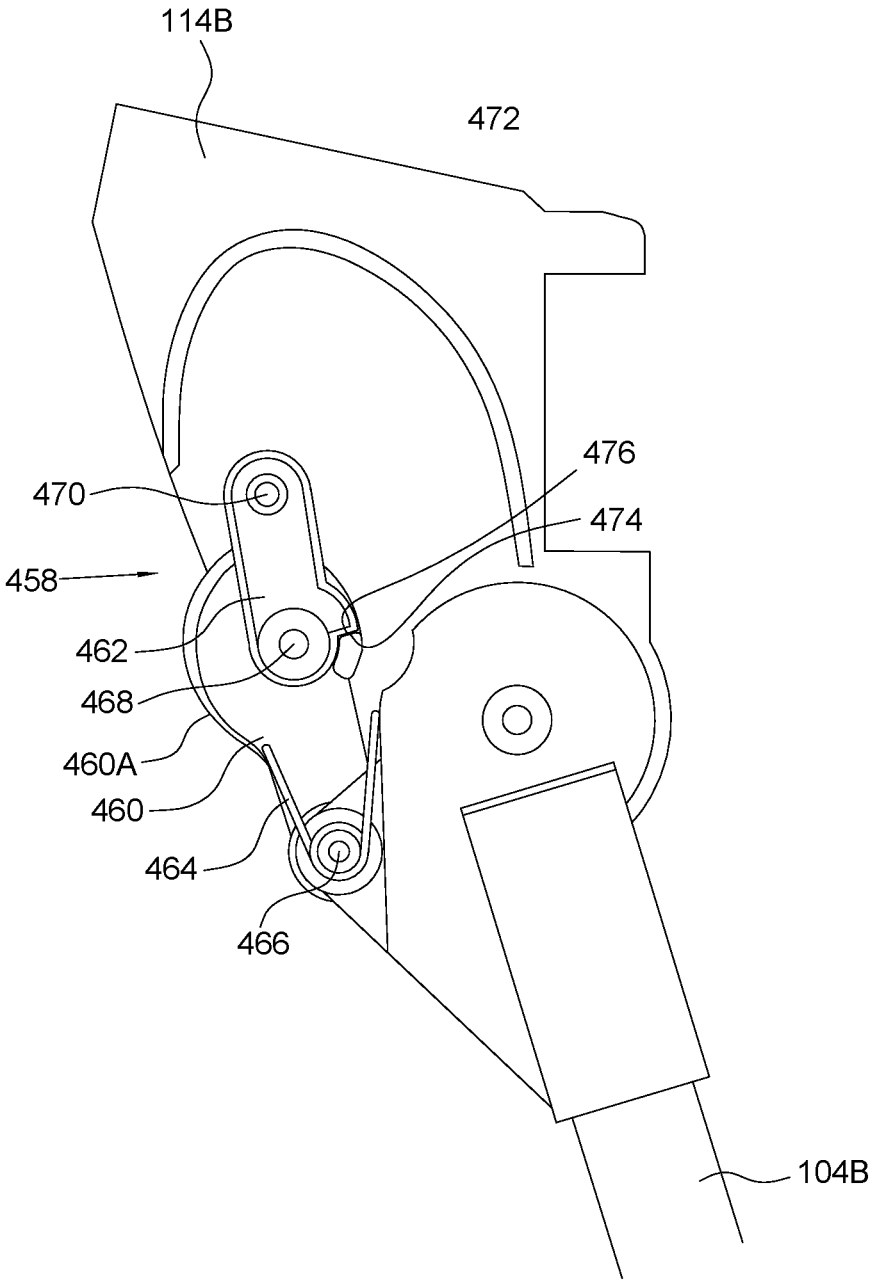
FIG. 12 is a schematic view illustrating another variant construction of a locking mechanism disposed adjacent to a corner joining part for locking a standing leg in the unfolded position.

FIG. 12 is schematic view illustrating another construction of a locking mechanism 458 disposed adjacent to the corner joining part 114B for locking the standing leg 104B in the unfolded position. Referring to FIG. 12, the locking mechanism 458 can include a latch 460, a linking part 462 and a spring 464 (shown with phantom lines).

The latch 460 can be pivotally connected with the standing leg 104B via a pivot connection 466, and the linking part 462 can be respectively connected pivotally with the latch 460 and the corner joining part 114B via two pivot connections 468 and 470. Each of the pivot connections 466, 468 and 470 may exemplary include a shaft portion disposed through corresponding holes provided in the pivotally coupled elements. This assembly can rotationally couple the standing leg 104B, the latch 460 and the linking part 462, wherein the latch 460 and the linking part 462 can rotate relative to each other and relative to the standing leg 104B and the corner joining part 114B during rotation of the standing leg 104B relative to the corner joining part 114B. Moreover, each of the latch 460 and the linking part 462 can have a stop surface that is radially distant from the pivot axis of the pivot connection 468, i.e., stop surface 474 for the latch 460 and stop surface 476 for the linking part 462. The stop surface 474 may be provided on a protrusion of the latch 460, and may move away or toward the stop surface 476 of the linking part 462 depending on the direction of rotation of the latch 460.

Referring to FIG. 12, the spring 464 can be connected with the latch 460, and can bias the latch 460 to rotate for protruding outside the corner joining part 114B, which corresponds to a direction of rotation that moves the stop surface 474 of the latch 460 and the stop surface 476 of the linking part 462 toward each other. According to an example of construction, the spring 464 may be a torsion spring assembled around the pivot connection 466.

When the standing leg 104B is in the unfolded state, the pivot connections 466, 468 and 470 can respectively define three distinct apexes of a triangle, and the stop surface 474 of the latch 460 can contact with the stop surface 476 of the linking part 462. Moreover, the biasing force applied by the spring 464 can keep the apex of the pivot connection 468 offset from a line joining the respective apexes of the pivot connections 466 and 470. The standing leg 104B can be thereby locked in the unfolded position, and the latch 460 can have an actuating portion 460A exposed in the unfolded position.

Figure 13:
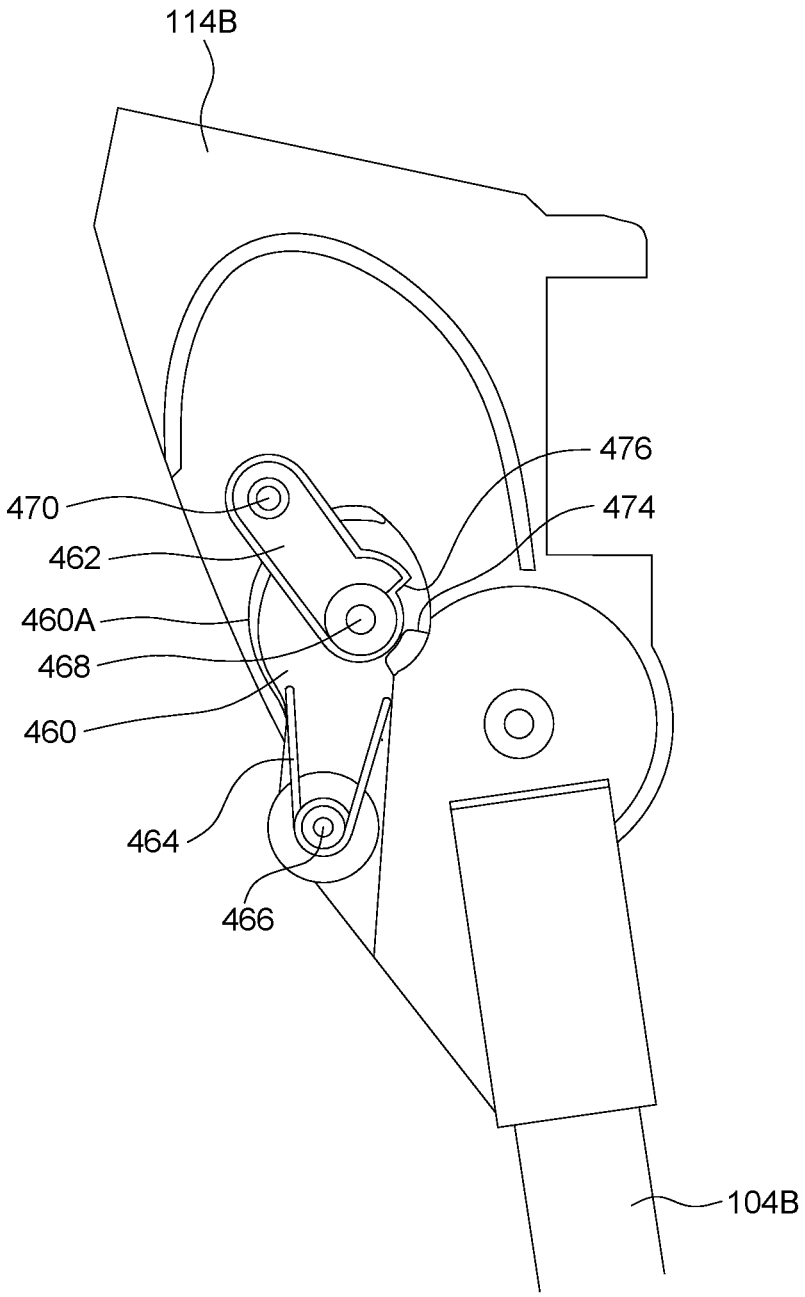
FIGS. 13 and 14 are schematic views illustrating exemplary operation of the locking mechanism shown in FIG. 12 for folding the standing leg.
Figure 14:
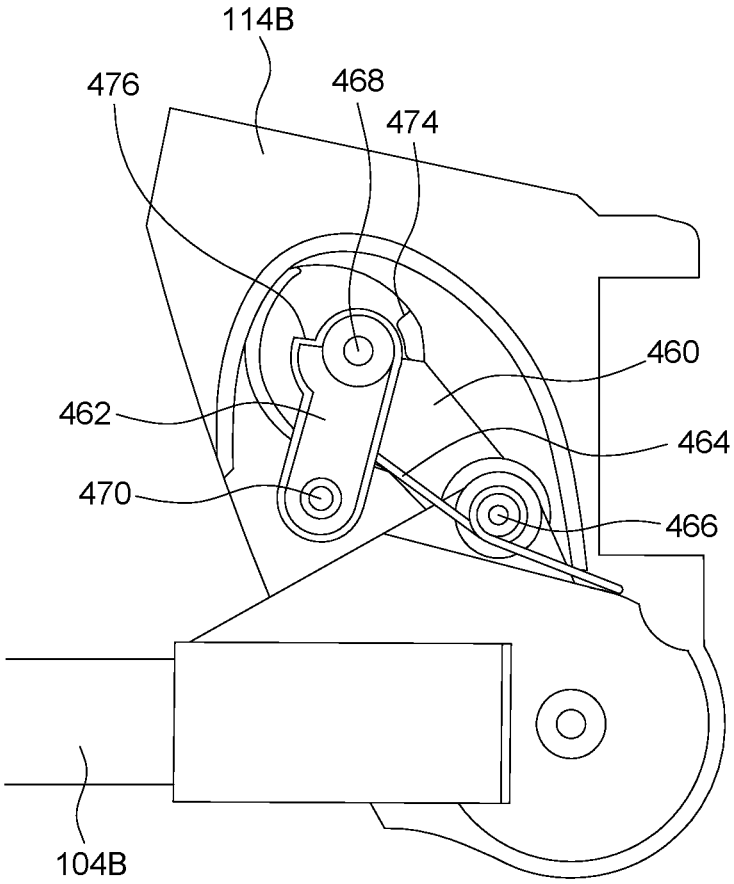

Referring to FIGS. 13 and 14, for folding the standing leg 104B, a caregiver can press the actuating portion 460A so that the latch 460 rotates toward an interior of the corner joining part 114B, which causes the stop surface 474 of the latch 460 to move away from the stop surface 476 of the linking part 462. The standing leg 104B can be thereby unlocked, and can then rotate in the folding direction. During rotation of the standing leg 104B, the latch 460 and the linking part 462 can move along with the standing leg 104B. Once the standing leg 104B is fully folded, the latch 460 and the linking part 462 can be entirely received inside the corner joining part 114B.

When the standing leg 104B is to be deployed, the standing leg 104B can be rotated in the unfolding direction, which causes the stop surface 474 of the latch 460 to move toward the stop surface 476 of the linking part 462. Once the standing leg 104B reaches the unfolded position, the stop surface 474 of the latch 460 can contact with the stop surface 476 of the linking part 462, which can lock the standing leg 104B in the unfolded position.

Since each of the standing legs 104A, 104B, 104C and 104D of the playpen 100 shown in FIG. 1 is folded and unfolded independently, any of the locking mechanisms 158, 258, 358 and 458 described herein can be provided adjacent to each of the corner joining parts 114A, 114B, 114C and 114D for locking the corresponding standing leg in the unfolded position.

Advantages of the structures described herein include the ability to provide a playpen that can independently fold and unfold standing legs, and have multiple folding configurations that may be set independently from one another, which can offer more flexibility for convenient transport and storage of the playpen. Moreover, because the playpen described herein has no bottom linkage, the weight of the playpen can be advantageously reduced.

Realization of the playpen has been described in the context of particular embodiments. These embodiments are meant to be illustrative and not limiting. Many variations, modifications, additions, and improvements are possible.

These and other variations, modifications, additions, and improvements may fall within the scope of the inventions as defined in the claims that follow.

What is claimed is:

1. A playpen comprising:

a plurality of standing legs;

an upper frame assembly coupled with the standing legs and having an unfolded state and a folded state, the upper frame assembly having a first side frame portion and a second side frame portion connecting with each other at a corner of the upper frame assembly, wherein the first side frame portion includes a corner joining part and a first bar fixedly connected with each other, and the second side frame portion includes a middle joining part, and a second bar respectively connected pivotally with the corner joining part and the middle joining part about a first and a second pivot axis, the first and second pivot axes extending substantially vertically when the playpen stands on a floor surface, the corner joining part further being pivotally connected with an end of a first one of the standing legs, the first standing leg being rotatable relative to the corner joining part between a folded position where the first standing leg is folded toward the upper frame assembly and an unfolded position where the first standing leg is deployed for providing standing support on a floor surface; and a locking mechanism for locking the upper frame assembly in the unfolded state;

wherein the corner joining part includes two opposite sidewalls that extend downward from the first bar and delimit at least partially a cavity adjacent to the first bar, the end of the first standing leg being movable inside the cavity between the two sidewalls as the first standing leg rotates relative to the corner joining part.

2. The playpen according to claim 1, wherein the second bar is fixedly connected with a coupling part having a curved shape that is pivotally connected with the corner joining part about the first pivot axis.

3. The playpen according to claim 1, wherein the corner joining part and the first bar of the first side frame portion are provided at a first side of the upper frame assembly that is not foldable, and the middle joining part and the second bar are provided at a second side of the upper frame assembly that is foldable.

4. The playpen according to claim 1, wherein the locking mechanism is carried with the middle joining part.

5. The playpen according to claim 4, wherein the locking mechanism includes a latch movable relative to the middle joining part between a locking position where the latch engages with the second bar for locking the upper frame assembly in the unfolded state, and an unlocking position where the latch is disengaged from the second bar for movement of the upper frame assembly between the unfolded state and the folded state.

6. The playpen according to claim 5, wherein the second bar has an end coupling part provided with an extension, the latch being engaged with the extension of the end coupling part in the locking position.

7. The playpen according to claim 5, wherein the locking mechanism further includes a spring connected with the latch, the spring being configured to bias the latch toward the locking position.

8. The playpen according to claim 5, wherein the latch has an actuating portion exposed for operation, the actuating portion being operable to cause the latch to move from the locking position to the unlocking position.

9. The playpen according to claim 8, wherein the actuating portion is formed integrally with the latch.

10. The playpen according to claim 1, further including a second locking mechanism disposed adjacent to the corner joining part, the second locking mechanism having a latch operable to lock the first standing leg in the unfolded position and unlock the first standing leg for rotation of the first standing leg between the unfolded position and the folded position.

11. A playpen comprising:

a plurality of standing legs;

an upper frame assembly coupled with the standing legs and having an unfolded state and a folded state, wherein the upper frame assembly has a side frame portion including two bars that are respectively connected pivotally with a middle joining part about two pivot axes, the two pivot axes extending substantially vertically when the playpen stands on a floor surface; and a locking mechanism for locking the upper frame assembly in the unfolded state, wherein the locking mechanism includes a latch carried with the middle joining part, the latch being movable relative to the middle joining part and the two bars between a locking position where the latch engages with the two bars for locking the upper frame assembly in the unfolded state, and an unlocking position where the latch is disengaged from the two bars so that the two bars are movable relative to the middle joining part and the disengaged latch for switching the upper frame assembly between the unfolded state and the folded state;

wherein the latch has a locking portion disposed in a gap between the two pivot axes, and each of the two bars has an end coupling part provided with an extension in the gap between the two pivot axes, the locking portion of the latch being movable in the gap to engage with and disengage from the extension of the end coupling part of each of the two bars.

12. The playpen according to claim 11, wherein the locking mechanism further includes a spring connected with the latch, the spring being configured to bias the latch toward the locking position.

13. The playpen according to claim 11, wherein the latch has an actuating portion exposed for operation, the actuating portion being operable to cause the latch to move from the locking position to the unlocking position.

14. The playpen according to claim 13, wherein the actuating portion is formed integrally with the latch.

15. The playpen according to claim 11, wherein the upper frame assembly further has a second side frame portion that is connected with the side frame portion via a corner joining part, the side frame portion defining a first side of the upper frame assembly that is foldable, and the second side frame portion defining a second side of the upper frame assembly that is not foldable.

16. The playpen according to claim 15, wherein the standing legs include a first standing leg pivotally connected with the corner joining part, the first standing leg being rotatable relative to the corner joining part between a folded position where the first standing leg is folded toward the upper frame assembly and an unfolded position where the first standing leg is deployed for providing standing support on a floor surface.

17. The playpen according to claim 16, further including a second locking mechanism disposed adjacent to the corner joining part, the second locking mechanism having a latch operable to lock the first standing leg in the unfolded position and unlock the first standing leg for rotation of the first standing leg between the unfolded position and the folded position.

* * * * *